United States Patent [19]

Shoemaker, Jr.

[11] 4,439,928

[45] Apr. 3, 1984

[54] DRAFTING INSTRUMENT

[76] Inventor: Dwight E. Shoemaker, Jr., 6003 Autumn Forest Dr., Houston, Tex. 77078

[21] Appl. No.: 346,960

[22] Filed: Feb. 8, 1982

Related U.S. Application Data

[63] Continuation-in-part of Ser. No. 97,128, Nov. 26, 1979, Pat. No. 4,314,408.

[51] Int. Cl.[3] ..... B43L 7/08

[52] U.S. Cl. ..... 33/494; 4/488

[58] Field of Search ..... 33/486–488, 33/491, 494, 483; 235/70 R

[56] References Cited

U.S. PATENT DOCUMENTS

| | | | |
|---|---|---|---|
| 713,097 | 11/1902 | Heydrick | 33/494 X |
| 2,124,550 | 7/1938 | Evans | 33/494 X |
| 2,156,524 | 5/1939 | Christensen | 33/491 |
| 2,178,293 | 10/1939 | Wogeck | 33/158 |
| 2,355,585 | 8/1944 | Halstead . | |
| 2,468,191 | 4/1949 | Fullilove . | |
| 2,651,235 | 9/1953 | Burrows . | |
| 2,736,097 | 2/1956 | Coleman . | |
| 2,832,141 | 4/1958 | Taylor . | |
| 2,954,611 | 10/1960 | Wiskoff | 33/494 X |
| 3,156,981 | 11/1964 | Sutton . | |
| 3,524,258 | 8/1970 | Novak . | |
| 3,738,009 | 12/1973 | Kuwada . | |
| 4,051,599 | 10/1977 | Sinkovec . | |

FOREIGN PATENT DOCUMENTS

| | | | |
|---|---|---|---|
| 1917768 | 10/1970 | Fed. Rep. of Germany | 33/491 |
| 593096 | 10/1947 | United Kingdom | 33/488 |

*Primary Examiner*—Charles E. Phillips

*Attorney, Agent, or Firm*—Arnold, White & Durkee

[57] ABSTRACT

A drafting instrument is disclosed providing for a large number of independently viewable scales in a single self-contained instrument. A flexible graphics sheet having a large number of scales thereon is attached to two rotatable shafts mounted within a housing. The housing has a viewing slot which allows the display of individual scales on the graphics sheet.

11 Claims, 26 Drawing Figures

3
3
5
5
8
8
21
21
34
47
47
24
24
37
59
59
22
30
33
32
31
38
1/4
3/16
1/8
3/32
10
20
50
28
29
27
57
59
47
34
24
30
22
36
74
84
61
35
23
45
40
42
39
43
44
50
58
56
54
53
52
51
55
50
49
23
46
48
45

30
22
31
66
65
70
71
64
68
67
68
25
69
72
63
62
61
35
60

73
36
74
84
75
76
82
26
81
80
81
77
83
78
79

32
30
22

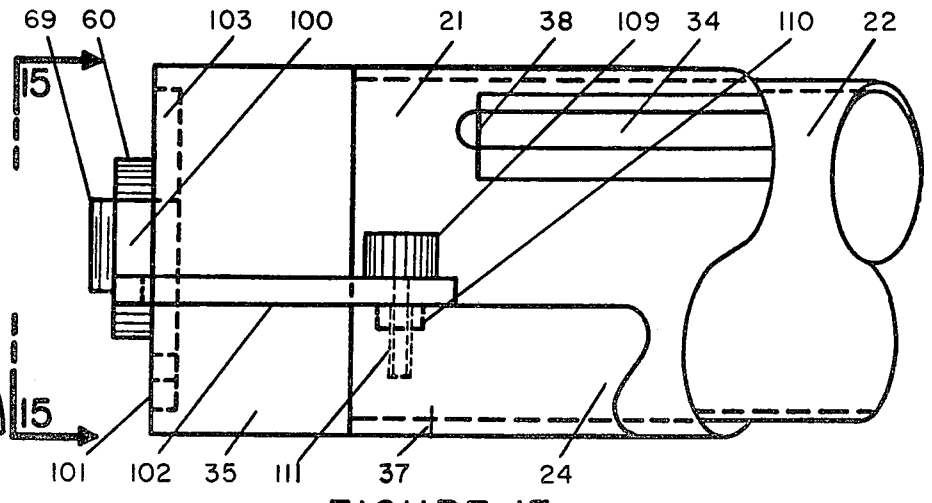
FIGURE 13
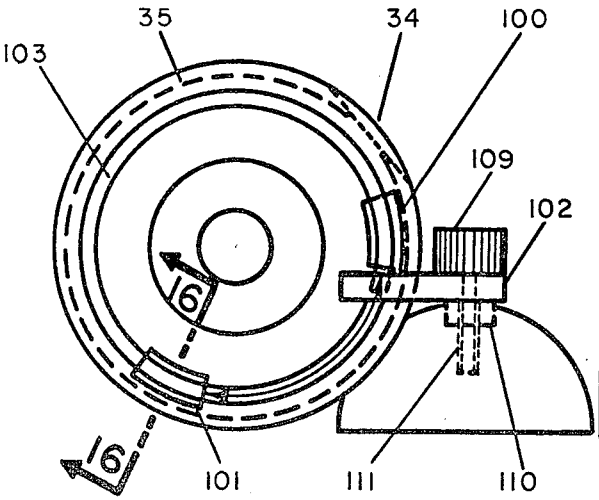
FIGURE 15
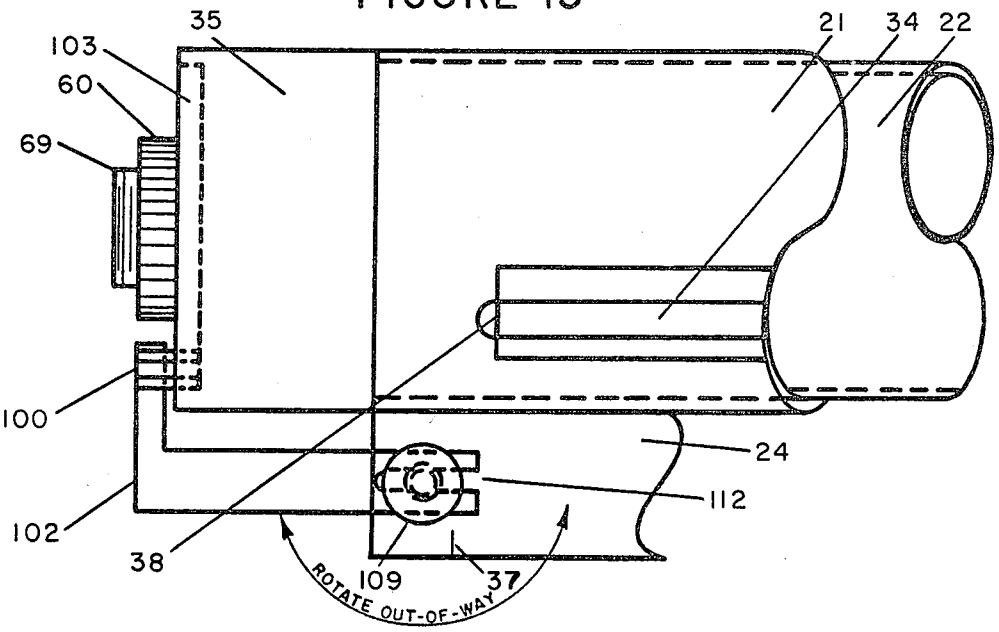
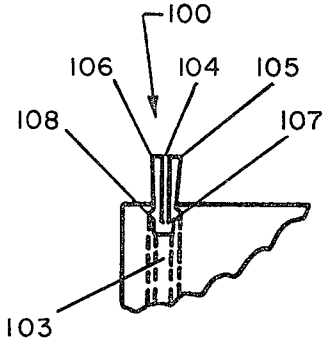
FIGURE 16

20
20
22
22
24
24
26
26
200
201
202
203
204
205
206
207
208
209
210
211
212
33
34
37
38

DRAFTING INSTRUMENT

CROSS REFERENCE TO RELATED APPLICATIONS

This application is a continuation in part of application Ser. No. 097,128, filed Nov. 26, 1979, now U.S Pat. No. 4,314,408.

BACKGROUND OF THE INVENTION

Applicant's U.S. Pat. No. 4,314,408 concerned a drafting instrument which combined a graphics tube having a limited number of engineering, architectural and other linear scales being rotatably mounted in an outer tubular body with a straightedge magnifier and a compass assembly. The present invention provides an improved housing having two rotatable shafts. A transparent Mylar sheet having a large number of scales thereon is attached to the rotatable shafts. Multiple scales are contained on the transparent Mylar sheet. Each scale may be brought into alignment with a viewing window so that it can be individually viewed.

Each graphics tube of the embodiment shown in U.S. Pat. No. 4,314,408 is limited to a maximum of about 20 scales. If, for example, 150 different scales are needed or desired, then 8 different graphics tubes would have to be purchased by the draftsman. In the present illustrated improved embodiment, 150 different scales may all be placed on a single graphics sheet and combined into a single self-contained instrument.

In the past, normal drafting procedures have required several tools having a variety of scales. It has been common for a draftsman to be required to purchase separately an architectural scale, an engineering scale and other scales in order to perform most ordinary drafting procedures. Not only is the purchase of all of the above instruments relatively expensive, but the utilization of so many instruments has necessitated frequent searching around the working area for the proper instrument. The invention disclosed herein combines multiple scales into a single self-contained package. An accurate cursor is provided for convenient accurate viewing of the scales.

In the past, drafting work has been very tedious and tiring to the eyes and has required a number of physical motions and procedures because numerous scales and numerous tools were required in order to perform most such drafting procedures. Frequent searching for the proper scales or other instruments around the working area has been required as a draftsman reaches a step in the procedure which requires a different scale. Thus, a need has existed for a single, inexpensive drafting tool which is accurate and which provides the necessary scales to perform most drafting procedures without the need for additional scales. The prior art arrangements have failed to disclose a single tool which could replace the need for separately purchasing an architect scale, an engineering scale, a plurality of map scales, an "80" scale, a millimeter scale, and a large number of other scales.

Applicant's U.S. Pat. No. 4,314,408 provided for increasing the number of scales by changing a replaceable graphics tube. The present invention is an improvement over that patent by providing for a large number of self-contained scales on a single transparent Mylar film. There is no need to search for additional graphics tubes when a large number of scales are needed. By turning two rotatable shafts, the Mylar film may be wound and unwound upon the shafts, respectively, to individually bring one of a large number of scales into alignment with a viewing window.

The problems enumerated above are not intended to be exhaustive. Other problems may also be apparent from the following detailed description of a preferred embodiment.

SUMMARY OF A PREFERRED EMBODIMENT OF THE INVENTION

Applicant's U.S. Pat. No. 4,314,408 provided the feature of a beam compass, a magnifier glass, a protractor, a linear proportional divider, and a limited number of scales in a single self-contained package in order to perform most ordinary drafting procedures. Applicant's prior patent allowed the number of scales to be expanded by replacing the graphics tube with a second graphics tube having different scales. This procedure would require searching for the correct graphics tube having the desired scales.

The present invention provides the improved feature of a large number of scales on a transparent Mylar film. The present invention avoids the need to replace a graphics tube. The Mylar film is contained within a housing in an arrangement that permits the scales to be selected and individually viewed, while maintaining the precise alignment required in a drafting instrument.

BRIEF DESCRIPTION OF THE DRAWINGS

In the drawings:

FIG. 13 shows an elevation view of an end of the tubular body and graphics tube illustrating the adjustable stop mechanism.

FIG. 14 is a top view of the adjustable stop mechanism.

FIG. 15 is an end view of the adjustable stop mechanism illustrated in FIG. 13.

FIG. 16 is a cross-sectional view of an adjustable stop.

DETAILED DESCRIPTION OF A PREFERRED EMBODIMENT OF THE INVENTION

Figure 1:
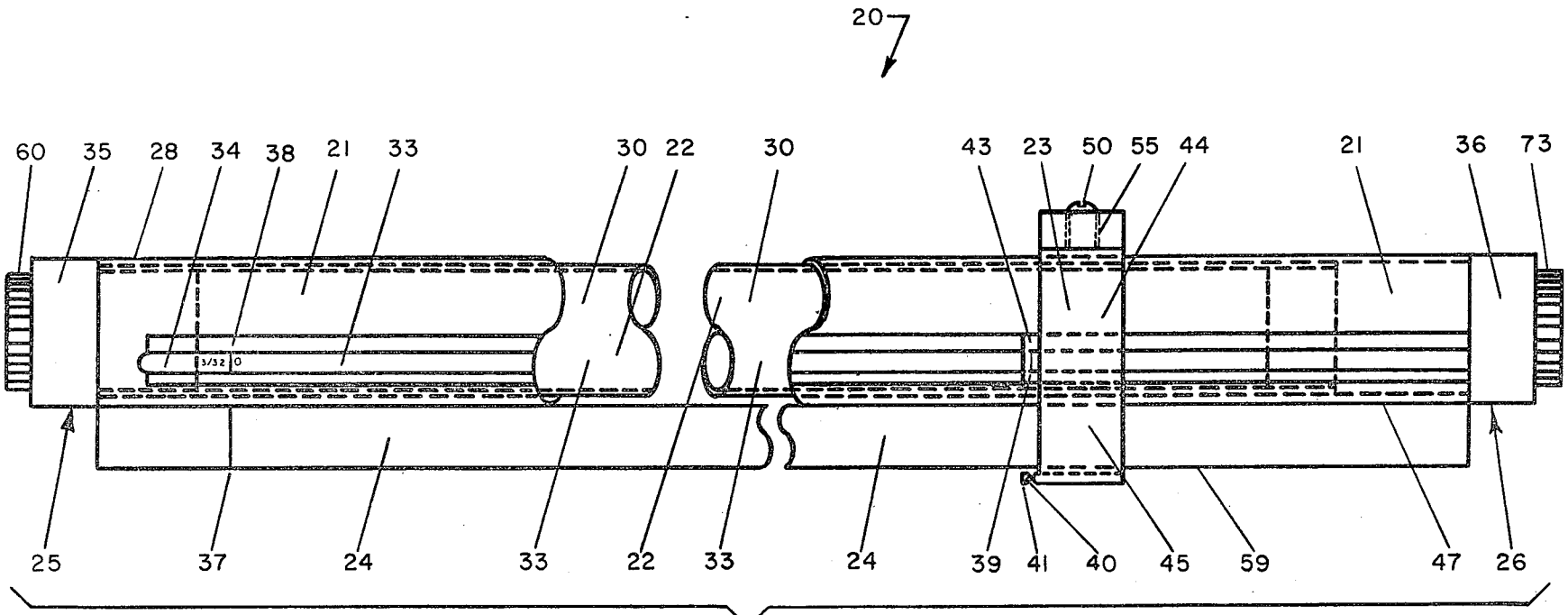
FIG. 1 depicts a fragmentary plan view of the drafting instrument showing the drafting instrument assembled with the pivot pin assembly and the scribing implement assembly stowed inside the graphics tube.

In the drawings, identical reference numerals designate like or corresponding parts throughout the several views. FIGS. 1 through 18 show a drafting instrument 20 that is disclosed in U.S. Pat. No. 4,314,408. FIGS. 19 through 26 illustrate an improved embodiment of the instrument.

The drafting instrument 20 comprises an outer tubular body 21, a graphics tube 22, a cursor assembly 23, a straightedge magnifier 24, a pivot pin assembly 25 and a marking implement or scribing implement assembly 26, as illustrated in FIG. 1.

Figures 2, 3, 4, 5, 6, 7, 8, 9:
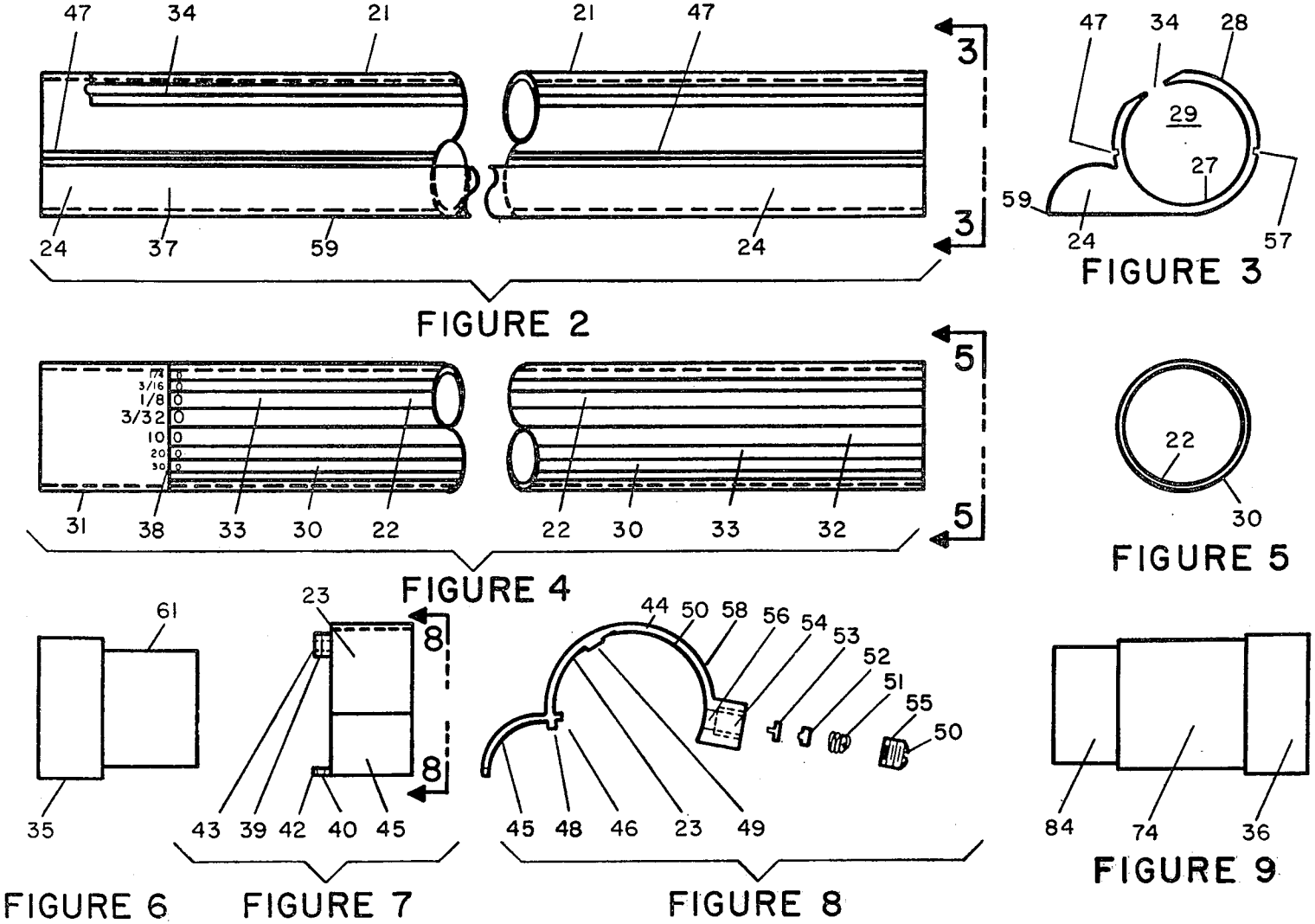
FIG. 2 illustrates a fragmentary elevation view showing the outer tubular body.
FIG. 3 shows a right side view of the outer tubular body.
FIG. 4 depicts a fragmentary elevation view illustrating the graphics tube.
FIG. 5 illustrates a side view of the graphics tube.
FIG. 6 shows an elevation view of the first end portion with the first raised knob.
FIG. 7 shows an elevation view and illustrates the cursor assembly.
FIG. 8 shows a fragmentary side view of the cursor assembly.
FIG. 9 depicts an elevation view of the second end portion with the second raised knob.

The outer tubular body or cylinder 21 is cylindrically shaped, having a bore or graphics tube receiving chamber 29. The tubular body 21 forms a tube which is adapted to receive the graphics tube 22. The graphics tube 22 is adapted to be coaxially inserted into the tubular body 21. As best shown in FIG. 3, the longitudinal bore 29 extends preferably substantially the entire length of the body 21. The bore 29 forms an inner surface 27 and an outer surface 28. The inner surface 27 has a radius which is preferably just large enough to permit the graphics tube 22 to be inserted into the bore 29 and rotate without inhibition. It will be understood that the bore 29 need not extend the entire length of the tubular body 21. The tubular body 21 could be constructed to permit the graphics tube 22 to be inserted in only one end of the tubular body 21. In a preferred embodiment, the bore 29 extends completely through the tubular body 21 in order to permit the pivot pin assembly 25 and the scribing implement assembly 26 to be inserted into the ends of the tubular body 21, as will be explained more fully below. The graphics tube 22 may be rotated by either the right hand or the left hand of a draftsman. The tubular body 21 provides support and a protective enclosure for the graphics tube 22.

Figure 18:
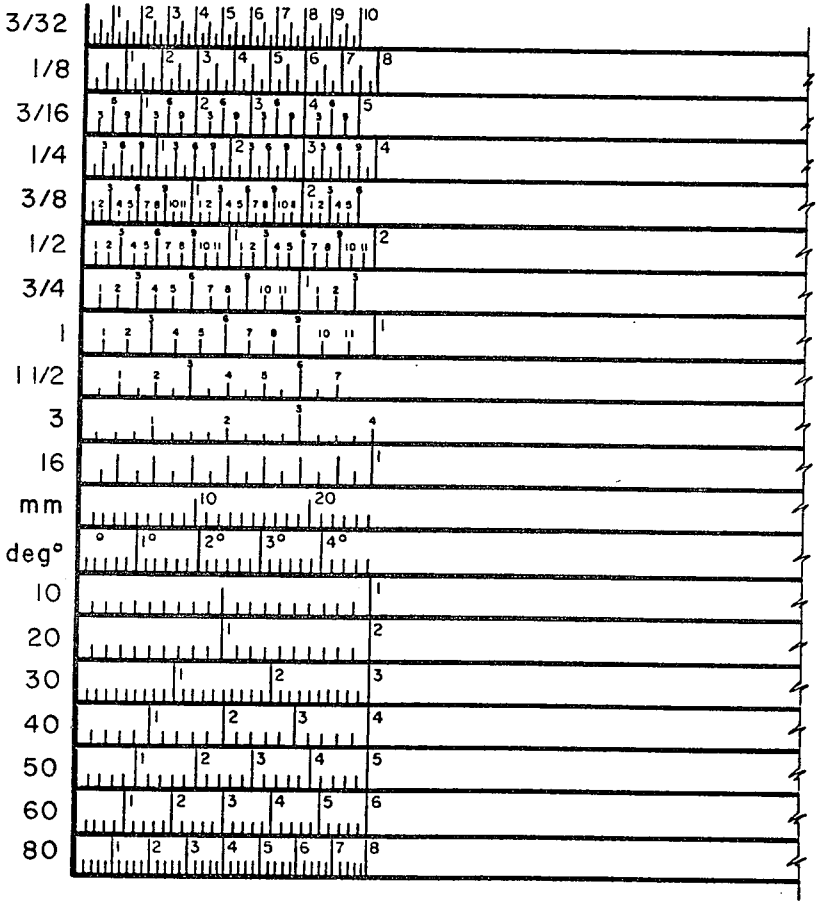
FIG. 18 illustrates scales to be used with the graphics tube.

In the present instance, as shown in FIG. 4, the graphics tube 22 has a face 30, a first end 31 and a second end 32. In the illustrated form the graphics tube 22 has a plurality of architectural and engineering scales 33 upon the face 30 of the tube 22. Millimeter scales and protractor scales 33 may also be included, as desired. An example of useful scales is shown in FIG. 18. It will be understood that other scales in addition to architectural and engineering scales 33 may be placed upon the graphics tube 22. Preferably, the graphics tube 22 may have twenty scales 33 upon its face 30. It will be understood that numerous graphics tubes 22 may be substituted one for another to provide a multitude of different scales 33 for use in connection with the instrument 20, including metric conversion scales. The improved embodiment, described below in reference to FIGS. 19 through 26 eliminates the need for multiple graphics tubes 22.

It is desirable to provide a means for displaying only one scale 33 at a time in order to reduce the eye strain and required concentration that the draftsman must maintain to insure that he does not take a reading from the wrong scale, particularly when the draftsman looks away from the instrument during the course of the measurement or series of measurements. In the illustrated embodiment, this is essentially accomplished by an axially elongated viewing slot or aperture 34. In a preferred embodiment, the viewing slot 34 is adapted to permit the display of only one scale 33 at a time, although the graphics tube 22 may be rotated as explained more fully below to display any one of the scales 33 at a time. In the present instance, the viewing slot 34 communicates between the inner surface 27 and the outer surface 28 and extends longitudinally along the tubular body 21 substantially the entire length of the tubular body 21. As shown best in FIG. 2, the viewing slot 34 starts a relatively short distance from an end of the tubular body 21 and extends completely to the other end of the tubular body 21. Preferably, the viewing slot 34 is long enough to permit full display of the scales 33 upon the graphics tube 22. If the scales 33 do not extend all of the way to the second end 32 of the graphics tube 22, then the viewing slot 34 may stop short of extending completely to one end of the outer tubular body 21. The viewing slot 34 preferably exposes the entire length of the scales 33.

In operation, the graphics tube 22 may be inserted into the tubular body 21, as shown in FIG. 1, and the graphics tube 22 rotated to bring any desired scale 33 into alignment with the viewing slot 34. In this manner any of the scales 33 are viewable through the viewing slot 34 when the graphics tube 22 is thus rotated to bring the corresponding face 30 of the graphics tube 22 into alignment with the viewing slot 34.

As will be explained more fully below, the pivot pin assembly 25 and the scribing implement assembly 26 may be inserted into the ends of the graphics tube 22 and the tubular body 21 in order to hold the graphics tube 22 within the tubular body 21 and inhibit longitudinal movement of the graphics tube 22 within the tubular body 21. As shown in FIG. 1, the pivot pin assembly 25 has a first raised knob, upset portion or flange 35. Similarly, the scribing implement assembly 26 has a second raised knob, upset portion or flange 36. The first and second knobs 35 and 36 provide a convenient means for properly aligning the graphics tube 22 within the tubular body 21, means for rotating the graphics tube 22 within the tubular body 21, and means for grasping the assembly 25 or 26 when used as a compass.

It is oftentimes desirable to magnify small images upon the working surface, especially where accurate measurements are desired. It is desirable to have this magnification done automatically without requiring the draftsman to hold a separate magnifier in his hand. In the illustrated embodiment, magnification is accomplished by the straightedge magnifier 24. The straightedge magnifier 24 is attached to the front part of the tubular body 21. The strain upon the draftsman's eyes is reduced by the instrument 20 because small, difficult-to-read images on a working surface or sheet of drafting paper (not shown) may be magnified by the straightedge magnifier 24. Accurate measurement is further facilitated by a fixed hairline register means 37. The fixed hairline register means 37, shown in FIG. 1, may be a thin straight line preferably placed upon the underside of the straightedge magnifier 24 and which is in corresponding alignment with initial or zero graduations 38 upon the scales 33. This arrangement avoids parallax problems. Thus, the fixed hairline register 37 provides a convenient indication of the initial or zero position 38 on the scales 33 which is superimposed upon a portion of the working surface or a sheet of drawing paper that is simultaneously magnified by the straightedge magnifier 24. The image of interest on the working surface is magnified; and this serves to facilitate measurements where the hairline register means 37 is used. The convenient magnification provided by the straightedge magnifier 24 serves to reduce the eye strain upon the draftsman.

Preferably, the straightedge magnifier 24 is constructed of transparent plastic and is fastened to the tubular body 21, which is preferably opaque. In practice, aluminum has proven to be a satisfactory material for the tubular body 21. Equivalent materials may include steel, plastic, polypropylene, transparent nylon, or a combination opaque material with a transparent panel molded therein.

Accurate measurement is further facilitated by the cursor assembly 23. The cursor assembly 23 has an upper hairline means or scale reading hairline means 39 and a lower hairline means or working surface hairline means 40. The lower hairline means 40 is in corresponding relationship to the upper hairline means 39 so that the distance between the lower hairline means 40 and the fixed hairline register means 37 can be read directly upon the appropriate scale 33 by reading a corresponding graduation appearing under the upper hairline means 39. In the present instance, the lower hairline means 40 is located in direct vertical correspondence with, or directly below, the upper hairline means 39. Preferably, the upper and lower hairline means 39 and 40 lie along the same line perpendicular to the scales 33. However, it will be understood that the lower hairline means 40 does not necessarily have to be located directly vertically below the upper hairline means 39. The scales 33 could be adjusted, if desired, to provide an appropriate reading upon the graduation aligned with the upper hairline means 39 even if the lower hairline means 40 were not directly below the upper hairline means 39.

In the embodiment illustrated in FIG. 1, the lower hairline means 40 may comprise a notch or detent in a protuberance or nib 41. Alternatively, as shown in FIG. 7, the lower hairline means 40 may comprise a thin line etched, drawn, or otherwise made upon a small projecting transparent finger 42, or a knife-edge embodiment may be used. In the illustrated embodiment, shown in FIG. 7, the finger 42 is generally rectangular in shape and connected to the cursor assembly 23. The upper hairline means 39 may comprise a similar transparent finger or projection 43 with an appropriate hairline upon it. If the nib 41, the finger 42 or the projection 43 have a significant thickness, then it is preferable to place the hairline upon the surface closest to the scales 33 or the working surface in order to avoid parallax problems. The finger 42 and the projection 43 may extend from either the left or the right side, or both, of the cursor 23.

The cursor assembly 23 is adapted to slide up and down the outer surface 28 of the tubular body 21. In a preferred embodiment, the cursor assembly 23 generally conforms to the shape of the outer tubular body 21 or generally registers upon the outer surface 28 of the tubular body 21 in order to inhibit radial movement of the cursor assembly 23 which might move the lower hairline means 40 out of alignment with the upper hairline means 39, or move the upper hairline means 39 out of alignment with the graduations upon the scales 33. As best shown in FIG. 8, the cursor assembly 23, according to a presently preferred embodiment, comprises a semicircular arc or tubular body cover 44 and an arcuate surface or magnifier cover 45, which are both adapted to generally conform to the shape of the outer surface 28 and the surface of the straightedge magnifier 24, respectively. Preferably, the magnifier cover surface 45 does not extend underneath the straightedge magnifier 24 in order to avoid interfering with the working surface when the cursor assembly 23 slides or is moved longitudinally upon the tubular body 21. It will be appreciated that the tubular body cover surface 44 fits upon the tubular body 21 in a generally coaxial relationship. The tubular body cover 44 may be shaped in the form of an arc which is greater than a semicircle, if desired. If shaped appropriately and fashioned out of resilient material, generally plastic, the cursor assembly 23 may be adapted to "snap on" the tubular body 21 and hold itself generally upon the outer tubular body 21. Preferably, the cursor assembly 23 may be placed upon the tubular body 21 by removing either the first or second raised knob 35 or 36 and sliding the cursor assembly 23 onto the end of the tubular body 21.

Most normal drafting procedures require the use of a straightedge or an instrument adapted to facilitate the drawing of a straight line. In the illustrated embodiment, this feature is substantially accomplished by the straightedge magnifier 24. The straightedge magnifier 24 has a straightedge 59. It will be understood by reference to FIG. 3 that the straightedge 59 is adapted to meet in positional agreement with a substantially planar working surface. Thus, a marking implement or scribing implement may be used to draw a straight line by drawing the implement along the straightedge 59 in accordance with standard drafting procedure.

Figure 12:
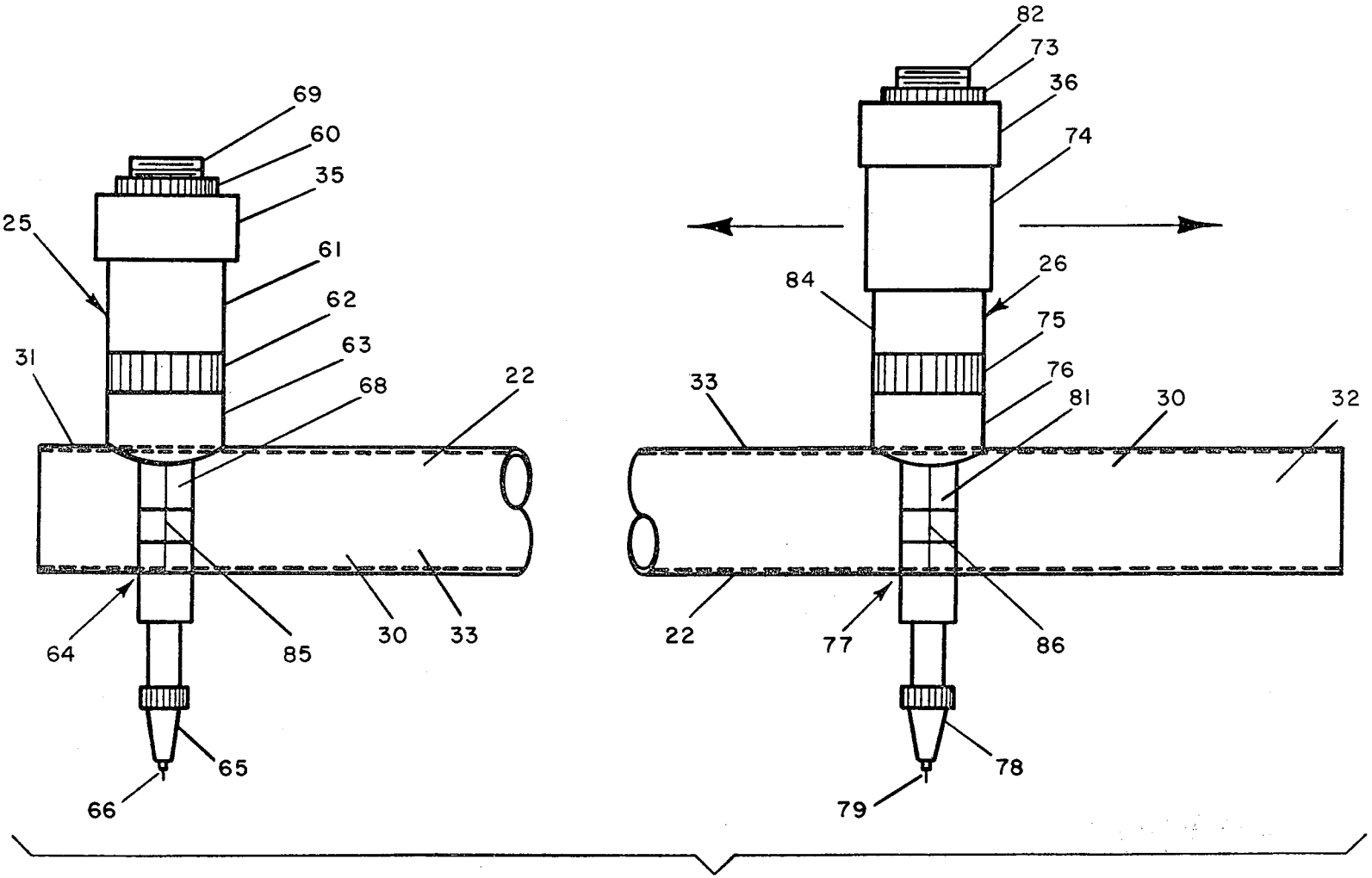
FIG. 12 shows a fragmentary elevation view of the pivot pin assembly, the graphics tube and the scribing implement assembly configured as a compass.

Many normal drafting procedures require the use of a compass or caliper. Thus, it is desirable to provide a single instrument 20 which is also adaptable to form a compass or caliper. As shown in FIG. 12, the instrument 20 may be configured as a compass or caliper substantially in accordance with the illustrated embodiment. The graphics tube 22 may be removed from the tubular body 21 and used in conjunction with the pivot pin assembly 25 and the scribing or marking implement assembly 26 to form a compass or a caliper.

Figures 10, 11:
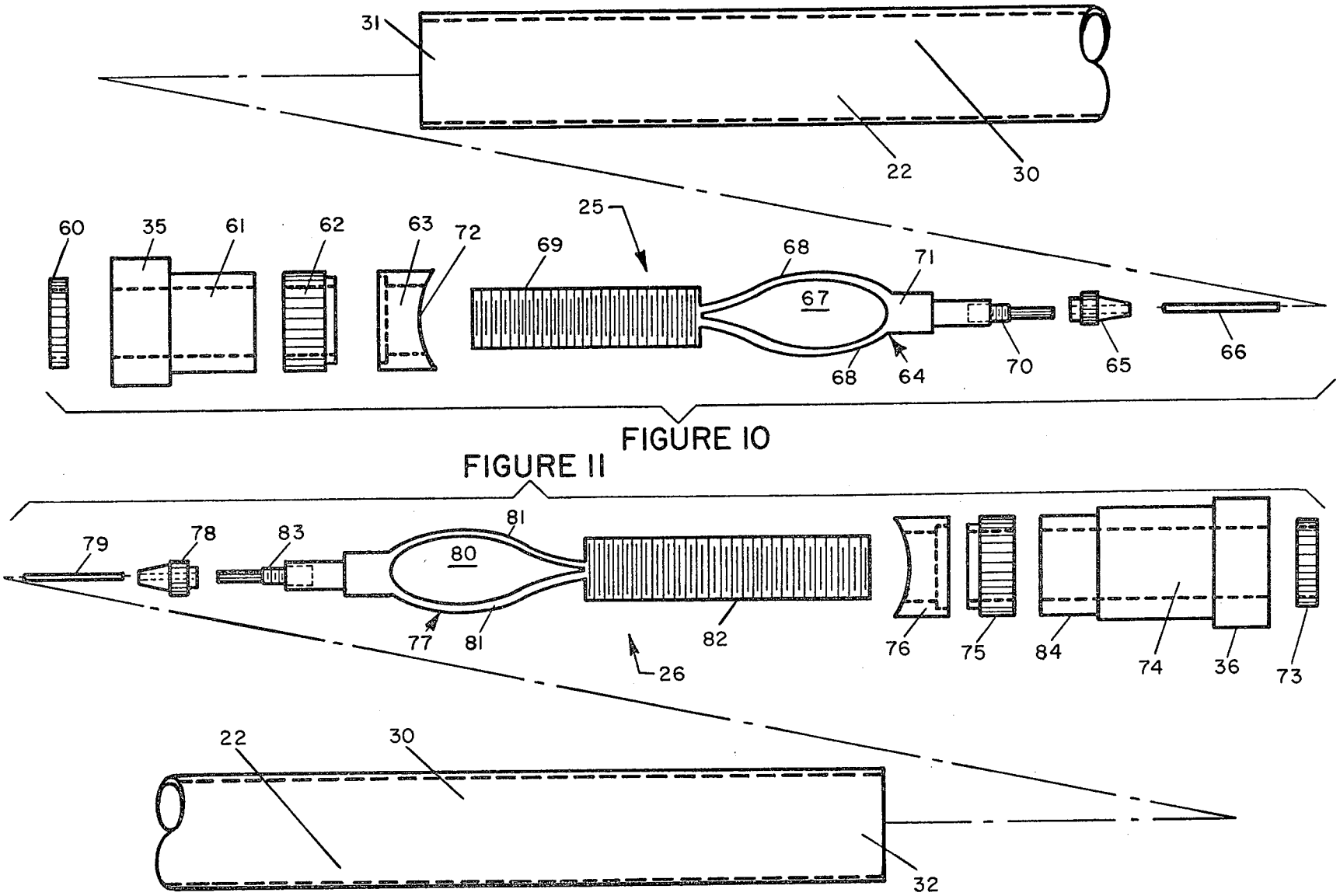
FIG. 10 illustrates a fragmentary elevation view of the pivot pin assembly and the graphics tube.
FIG. 11 depicts a fragmentary elevation view of the scribing implement assembly and the graphics tube.

As best shown in FIG. 10, the pivot pin assembly 25 comprises a first set nut 60, a first end portion 61, a first lock nut 62, a first saddle 63, a first flex-band assembly 64, a pin chuck 65 and a pin point 66. The pivot pin assembly 25 may be assembled as shown in FIG. 12. Referring to FIG. 10, the first flex-band assembly 64 has a first aperture 67 formed by flexible or resilient walls 68. The walls 68 are flexible to permit them to be compressed so that the pivot pin assembly 25 may be stowed or placed within the first end 31 of the graphics tube 22. The walls 68 are also resilient in order to permit sufficient expansion so that the graphics tube 22 may be inserted into the first aperture 67 to form a compass or caliper assembly as shown in FIG. 12. Although the first aperture 67 is shown in FIG. 10 as being generally oval in shape, when the walls 68 are expanded to permit insertion of the graphics tube 22, the walls 68 preferably expand to form a circular first aperture 67 which snugly fits in corresponding relationship with the face 30 of the graphics tube 22.

The first flex-band assembly 64 further comprises a first threaded post 69 and a threaded pin chuck receiving post 70. In the illustrated embodiment of FIG. 10, the first threaded post 69 and the threaded pin chuck receiving post 70 are securely joined to a center portion 71 of the first flex-band assembly 64. Preferably, the flex-band assembly 64 is fashioned into a single object comprising a one-piece construction.

The first saddle 63 is adapted to coaxially fit upon the first threaded post 69. The first lock nut 62 has a bore extending through it having threads corresponding to the threads upon the first threaded post 69 and is adapted to screw down upon the first threaded post 69 to compress the walls against the graphic tube 22 for locking in place during use. The first end portion 61 is adapted to coaxially fit upon the first threaded post 69 of the first flex-band assembly 64. The first set nut 60 has a bore extending through it with threads corresponding to the threads upon the first threaded post 69 and is adapted to screw down upon the first threaded post 69. The first set nut 60 may alternatively comprise a snap-on fastener of a conventional type. Thus, in the illustrated embodiment, the first saddle 63, the first lock nut 62, the first end portion 61 and the first set nut 60 may be assembled upon the first threaded post 69 as shown in FIG. 12. The first saddle 63 may be generally shaped in the form of a circular arc or arcuate surface 72 which is adapted to positionally agree with the curved face 30 of the graphics tube 22.

Figure 17:
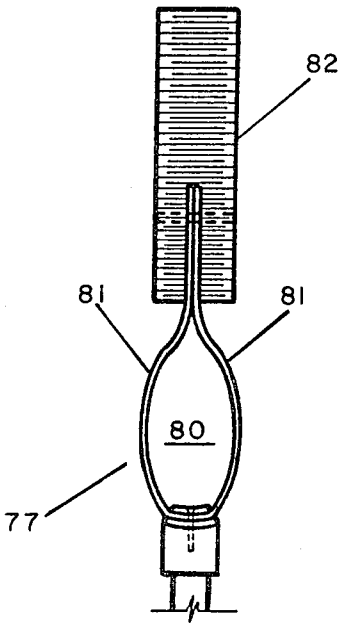
FIG. 17 shows an alternative embodiment of the flex band assembly.

An alternative construction of the flex-band assemblies 64 and 77 has given satisfactory results in practice, and is shown in FIG. 17. The resilient walls 81 are formed from a single, generally rectangular piece of plastic which is sufficiently flexible to be looped such that the two ends are joined, as shown in FIG. 17. The ends are securely joined to the threaded post 82. The saddle 76 may be tightened down on the piece of plastic to conform the size of the aperture 80 to the size of the graphics tube 22.

This alternative construction as shown in FIG. 17 permits the flex band assembly 77 to be stowed inside the graphics tube 22 when not in use, and has an additional advantage of accommodating varying sizes of graphics tubes 22, if desired.

Referring to FIG. 11, the scribing implement assembly 26 comprises a second set nut 73, a second end portion 74, a second lock nut 75, a second saddle 76, a second flex-band assembly 77, a scribing or marking implement chuck 78 and a scribing or marking implement 79. The scribing implement assembly 26 in the present instance is constructed generally similarly to the pivot pin assembly 25, except that the scribing implement assembly 26 normally has a scribing implement chuck 78 which is adapted to hold a scribing or marking implement 79, generally comprising pencil lead, a pen implement or a caliper point.

The scribing implement assembly 26 has a second aperture 80 formed by flexible and resilient walls 81. The scribing implement asembly 26 is adapted to stow, seat or fit within the second end 32 of the graphics tube 22 when the instrument 20 is configured as shown in FIG. 1. The scribing implement assembly 26 may be removed from the second end 32 of the graphics tube 22, the graphics tube 22 removed from the tubular body 21, and the graphics tube 22 may be inserted into the second aperture 80 and the scribing instrument assembly 26 "locked" in place to form a compass or caliper assembly as shown in FIG. 12. As will be apparent to those skilled in the art, the scribing implement assembly 26, when fixed to the graphics tube 22 along with the pivot pin assembly 25, may be used to scribe circles around the pin point 66. It will be understood that the scribing implement 79 may be replaced by a pin point and the instrument illustrated in FIG. 12 may be used as a caliper or as a divider.

It is desirable when scribing or drawing circles or large arcs, that the draftsman need not change his grip upon the instrument. Additionally, a draftsman may be able to draw a circle with one hand. This reduces the chance of dropping the instrument. This feature is achieved in the disclosed embodiment by making the first raised knob 35 rotatable, and by making the second raised knob 36 also rotatable. The simultaneously rotatable knobs 35 and 36 permit circles or relatively large arcs to be drawn with ease and without adjusting one's grip upon the second knob 36 or the first knob 35. The first raised knob 35 and the first end portion 61 are preferably formed into a one-piece configuration. The first raised knob 35 forms a conveniently grasped handle upon the first end portion 61, and both are constructed such that rotation of the first knob 35 about the axis of the pivot pin assembly 25 is freely permitted, yet radial movement of the first knob 35 with respect to the graphics tube 22 as shown in FIG. 12 is generally inhibited. The second raised knob 36 and second end portion 74 are preferably similarly constructed, except that in the illustrated embodiment, the second end portion 74 has a spacing member 84 formed thereon between the second lock nut 75 and the second end portion 74. In use, the first lock nut 62 may be tightened upon the first threaded post 69 in order to tighten the first saddle 63 against the face 30 of the graphics tube 22 and thus inhibit the pivot pin assembly 25 from sliding or rotating upon the graphics tube 22. Similarly, the second lock nut 75 may be tightened down upon the second threaded post 82 in order to tighten the second saddle 76 into secure engagement with the face 30 of the graphics tube 22, thus locking it into place. In practice, the second lock nut 75 is typically loosened to permit the scribing implement assembly 26 to slide to the desired position upon the graphics tube 22 and then the second lock nut 75 is tightened down upon the second saddle 76 to inhibit the scribing implement assembly 26 from sliding away or rotating from the desired setting. This feature improves the accuracy of the arcs or curves sought to be scribed. This feature also maintains the distance between the pin point 66 and the scribing implement 79 (or a pin point substituted therefor when the instrument is used as a caliper).

At least one of the walls 68 of the first flex-band assembly 64 should preferably be transparent to permit the scales 33 upon the face 30 of the graphics tube 22 to be viewed. The wall 68 preferably has a first compass hairline means 85 thereon whcih permits accurate alignment of the pivot pin assembly 25 upon the scales 33 of the graphics 22. It will be appreciated that the first compass hairline means 85 preferably is in corresponding relationship to, or correct calibration with, the pin point 66. Similarly, the walls 81 of the scribing implement assembly 26 are preferably transparent having a second compass hairline means 86 thereon. In operation, the first compass hairline means 85 may be aligned in correspondence with the initial or zero graduations 38 upon the scales 33 and the second compass hairline means 86 may be then used to measure the distance upon the scales 33 between the pin point 66 and the scribing implement 79, or alternatively the second compass hairline means 86 may be placed into corresponding position upon the desired graduation upon the scales 33, that is, it may be set any desired distance on the scales 33.

It is sometimes desirable to be able to flip back and forth quickly between two scales. For example, the drafting instrument described herein may be employed as a proportional divider by using two scales 33 on the graphics tube 22 which are scaled in the same proportion with respect to each other as the proportion by which the proportional division is desired. Those familiar with proportional dividers and drafting procedures related thereto will readily appreciate that the instrument disclosed herein may be used as a proportional divider by flipping back and forth between two desired scales 33.

The use of the disclosed instrument as a proportional divider is greatly facilitated by a first and second adjustable stop 100 and 101, and a fixed stop 102, as shown in FIGS. 13, 14, 15 and 16. As best shown in FIG. 15, a stop groove 103 is formed upon the knob 35. When the adjustable stops 100 and 101 are placed within the stop groove 103, the graphics tube 22 may be readily rotated within the tubular body 21 to a specific desired scale 33 because the adjustable stop 100 or 101 will contact the fixed stop 102 and inhibit further rotation of the graphics tube 22. When the adjustable stop 100 is in contact with the fixed stop 102, the desired scale 33 will be in alignment with the viewing slot 34. Similarly, when the second adjustable stop 101 is brought into contact with the fixed stop 102, the second desired scale 33 will be brought into corresponding alignment with the viewing slot 34. Thus, the graphics tube 22 may be readily rotated back and forth between two desired scales to facilitate operation of the instrument as a proportional divider. This will also facilitate conversion between two scales, for example, metric to English, or vice-versa.

Turning now to FIG. 16, the adjustable stop 100 is preferably formed in a V-shape. A space 104 between legs 105 and 106 of the stop 100 permit the legs 105 and 106 to be squeezed together to facilitate removal of the stop 100 from the stop groove 103. The adjustable stops 100 and 101 are preferably fashioned from flexible material, and plastic has given satisfactory results in practice. The stop 100 may have cleats 107 and 108 to hold the stop 100 securely in place when it is inserted into the stop groove 103. It will be appreciated that the second adjustable stop 101 is constructed similarly to the first adjustable stop 100.

Referring to FIG. 13, it will be seen that the fixed stop 102 is fastened to one end of the straightedge magnifier 24 by means of a set screw 109 and a washer 110 which fits within a tapped hole 111. The set screw 109 may be securely screwed into the tapped hole 111 to hold the fixed stop 102 into position.

As best shown in FIG. 14, the fixed stop 102 is preferably L-shaped. The fixed stop 102 has a notch 112 cut in one end to permit the fixed stop 102 to be inserted between the head of the set screw 109 and the straightedge magnifier 24. If desired, the set screw 109 may be loosened to permit the fixed stop 102 to be rotated counterclockwise as shown in FIG. 14. This rotation will disable the adjustable stop mechanism so that the graphics tube 22 may once again be rotated freely without removing the adjustable stops 100 and 101.

Conversion tables, important constants, and other useful information may be inscribed upon the outer surface 28 of the tubular body 21, or upon additional interchangeable graphics tubes 22.

All scales 33 preferably have a common zero point, or an initial graduation 38, as shown in FIG. 4 and in FIG. 18, including the architectural scales. The zero point of conventional architectural scales are not aligned, in order to allow for an additional increment to show the "inch" graduations. In the illustrated embodiment of the instrument 20, the inch markings extend throughout the entire length of each architectural scale 33 allowing for a common zero point 38.

It will be apparent that the graphics tube 22 may be rotated within the first and second apertures 67 and 80 in order to bring any desired scale 33 upon the face 30 of the graphics tube 22 into corresponding alignment with the first and second compass hairline means 85 and 86.

The above described embodiment of a drafting instrument 20 requires the use of several graphics tubes 22 if a large number of scales 33 are desired. The disclosed embodiment has been limited in practice to about twenty scales 33 on a single graphics tube 22. An improved embodiment of a drafting instrument is illustrated in FIGS. 19 through 26, which allows for the use of a large number of scales 33 upon a transparent Mylar film 200, which may also be referred to as a flexible graphics sheet 200. Using a Mylar sheet 200 having a thickness of about 3 mils, approximately 150 scales 33 may be put onto a single sheet 200. This improved embodiment could replace over seven graphics tubes 22.

The improved embodiment includes a housing 201, a resilient graphics guide 202, a cursor assembly 203, an end piece 204, a forward rotatable shaft 205, and a rear rotatable shaft 206. The ends of the flexible graphics sheet 200 are attached to the forward rotatable shaft 205 and the rear rotatable shaft 206, and the flexible graphics sheet 200 is wound around the forward and rear rotatable shafts 205 and 206. The forward and rear shafts 205 and 206 are provided with knobs 207.

Figures 19, 20, 21, 22, 23, 24, 25, 26:
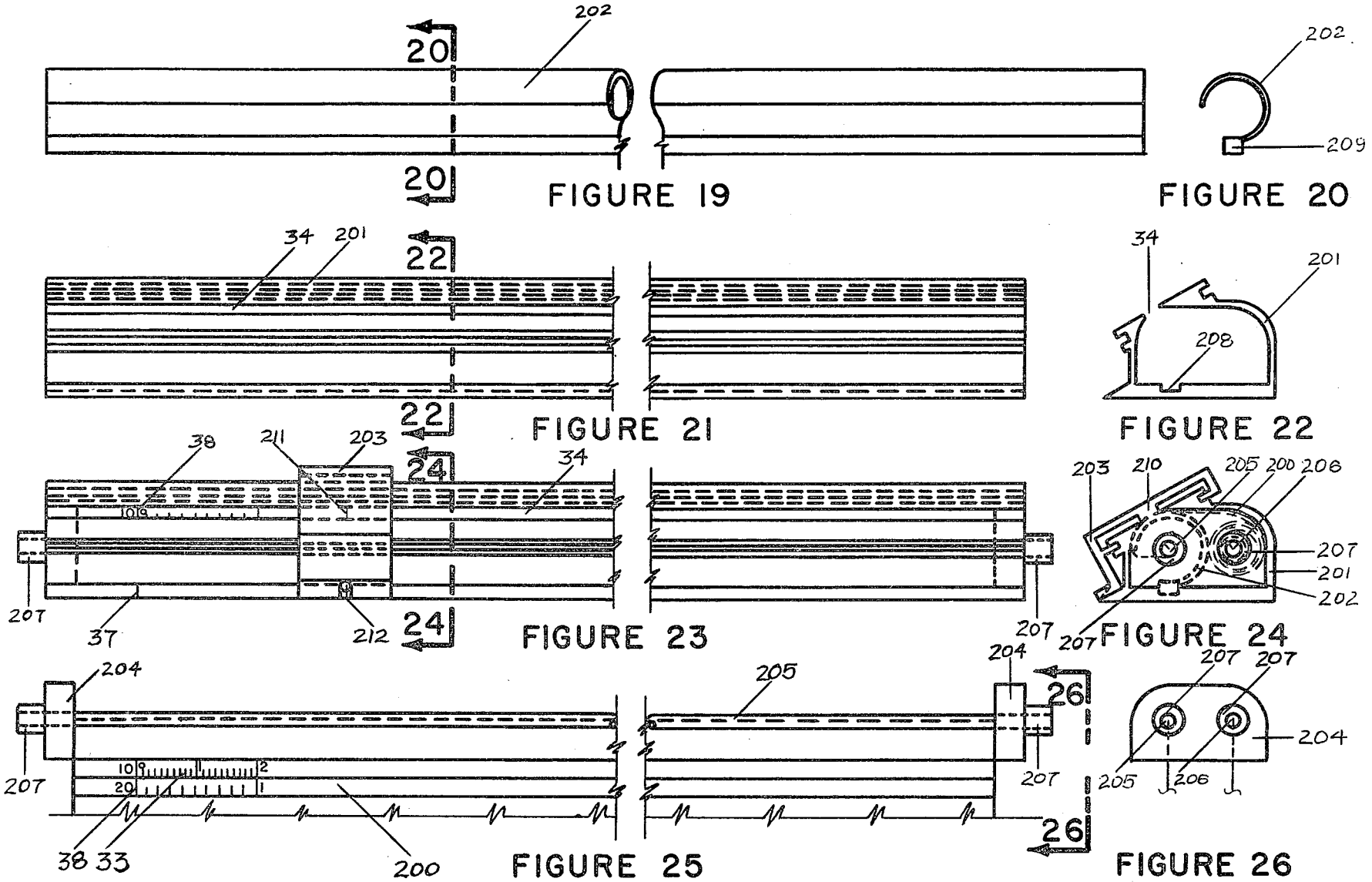
FIG. 19 shows a fragmentary elevation view of the resilient graphics guide.
FIG. 20 is an end view of the resilient graphics guide.
FIG. 21 is a fragmentary elevation view of the housing.
FIG. 22 is an end view of the housing.
FIG. 23 is a fragmentary elevation view of the assembled instrument.
FIG. 24 is a cutaway end view of the assembled instrument.
FIG. 25 is a fragmentary elevation view of one of the rotatable shafts and part of the scales.
FIG. 26 is an end view of an end piece.

Most draftsmen are required to have and use a large number of scales 33 in connection with their drafting procedures. The requirement that a large number of scales 33 be utilized from day to day generally means that the draftsman must hunt and search for the appropriate scales 33 during the various steps of various procedures. The present invention eliminates the requirement that the draftsman search for the appropriate instrument having the desired scales 33. The present invention provides for the use of a large number of scales 33 on the same instrument, and yet avoids confusion and reduces the required level of concentration by providing that the scales 33 may be individually viewed. Referring to FIGS. 23 and 24, this is essentially accomplished in the present invention by the transparent Mylar film 200 which is shown wound around the rear rotatable shaft 206 and having one end of the graphics sheet 200 attached to the forward rotatable shaft 205. A viewing slot or aperture 34 is adapted to allow the display of a single scale 33 at a time. The forward rotatable shaft 205 may be rotated simultaneously with the rear rotatable shaft 206 to wind the transparent graphics sheet 200 around the forward rotatable shaft 205, and thus bring into view any scale 33 on the graphics sheet 200.

In utilizing scales on a drafting instrument, the precise alignment of the scales 33 is critical. In the illustrated improved embodiment, precise alignment of the scales 33 is facilitated by the resilient graphics guide 202, which is illustrated separately in FIGS. 19 and 20. When placed in the housing 201, the resilient graphics guide 202 holds the graphics sheet 200 in precise alignment with the viewing slot 34. The resilient graphics guide 202 is adapted to resiliently urge the flexible graphics sheet 200 against the viewing slot 34. This action also provides a certain amount of friction or drag sufficient to hold the selected scale 33 in alignment with the viewing slot 34. The resilient graphics guide 202 fits into a slot 208 on the interior of the housing 201. The resilient graphics guide 202 has a foot 209 which is adapted to mate with the slot 208.

To further facilitate the precise alignment of the scales 33, the cursor assembly 203 has a rib 210 shown in FIG. 24 which fits into the viewing slot 34. The rib 210 helps to eliminate parrallax problems in reading the scales 33. A hairline 211 is preferably placed on the rib 210 on the side immediately adjacent the graphics sheet 200, to reduce errors that may occur when the hairline 211 is viewed at different viewing angle. A "V" groove 212 is preferably provided at the lower edge of the cursor assembly 203, which is in corresponding alignment with the hairline 211. In practice, a measurement can be made by aligning the hairline 211 with the scales 33. The draftsman may then take his pencil and place it in the "V" groove 212. The pencil may then be moved from the "V" groove 212 to the drafting surface for a precise pencil marking which corresponds with the measurement. A fixed hairline register 37 corresponds with the zero position 38 of the scales 33 to facilitate precise measurements.

The end pieces 204 are adapted to fit into the ends of the housing 201 to hold the rotatable shafts 205 and 206 in position. The end pieces 204 have holes or apertures which are adapted to receive the shafts 205 and 206.

The housing 201 is preferably made from aluminum for strength and light weight. The resilient graphics guide 202 is preferably plastic, and preferably colored yellow. The flexible graphics sheet 200 is preferably transparent Mylar for strength and accuracy. A preferred thickness of Mylar equal to about 3 mils will provide space for about 150 scales 33 to be placed upon the graphics sheet 200. Mylar is a preferred material for the graphics sheet 200 because it provides sufficient dimensional stability to insure accuracy. The transparent scales 33 will appear yellow when viewed against the background of the yellow plastic graphics guide 202. The scales 33 are preferably dark blue in color to provide a pleasing appearance and suitable contrast to reduce eye strain.

SUMMARY OF ADVANTAGES OF THE INVENTION

A drafting instrument manufactured in accordance with the present invention has the advantage of providing a large number of scales which may be combined within a single drafting instrument, thus eliminating the need for numerous separate scales. The provision of multiple scales in a single instrument provides the advantage and convenience of eliminating the need to search around the drafting room for an instrument having the desired scales during the course of various drafting procedures.

More particularly, the present invention provides for a large number of scales while maintaining the precision that is critical with a drafting instrument. The resilient graphics guide eliminates the problems that would otherwise be associated with attempts to utilize a large number of scales on a transparent sheet by maintaining the transparent sheet in precise alignment with a cursor assembly. A Mylar sheet provides sufficient dimensional stability to insure accuracy.

All scales have a common zero, including architectural scales, facilitating ease of operation of the conveniently rotatable scales by maintaining a common reference or initial point on each scale when the various scales are rotated into alignment with the viewing slot, and also simplifying the reading of the architectural scales. All scales are read on the same side of the instrument without the necessity of turning the instrument over or around to find the needed scale, as in prior art devices. The scales are individually displayed to eliminate confusion between adjacent scales.

The ease of quickly running through a large number of scales provides the advantage of being able to easily and quickly determine the scale of a drawing. The drafting instrument provides the advantage of reducing eye strain by displaying only a single scale at a time and reduces the level of concentration required on the part of the draftsman if he looks down from the instrument onto the working surface and then looks back up again to attempt to locate a desired position upon the displayed scale. The hairline on the cursor also serves to mark or record the location of a reading on a scale when looking away or changing scales. The fixed hairline register means upon the lower surface of the housing reduces eye strain by providing a convenient hairline in alignment with initial graduations on the scales to facilitate accurate alignment of the instrument upon the working surface. The "V" groove and the hairline on the cursor assembly provide the advantage of reducing eye strain by providing an accurate indication directly upon the working surface of the point which corresponds with the position of the hairline upon the displayed scale on the graphics.

The present invention provides the advantage of permitting the use of a practically unlimited number of scales. Significant cost savings are realized because a single instrument can replace several scales which would otherwise have to be purchased separately. The disclosed embodiment will permit about 150 scales to be placed on a single graphics sheet. The present invention has the virtue of simplicity while maintaining the accuracy that is crucial to drafting procedures. Drafting procedures may be accomplished more quickly and easily than may be accomplished with conventional drafting instruments, because the delay introduced by the requirement of searching for separate scales is avoided.

The foregoing description of the invention has been directed to a particular preferred embodiment for purposes of explanation and illustration. It will be apparent to those skilled in the art that modifications and changes in the instrument may be made without departing from the scope and spirit of the invention. This description is to be construed as illustrative only and is not to be construed as limiting the scope of the invention as defined in the appended claims.

What is claimed is:

1. A drafting instrument having a large number of independently viewable scales, comprising:

a hollow housing, the housing having a viewing slot;

a resilient graphics guide, the resilient graphics guide being fixedly attached to the housing;

a rear rotatable shaft, the rear rotatable shaft being adapted to fit within the housing;

a forward rotatable shaft, the forward rotatable shaft being adapted to fit within the housing;

a flexible graphics sheet, the flexible graphics sheet having a plurality of scales thereon, the flexible graphics sheet having a first end attached to the rear rotatable shaft, the flexible graphics sheet having a second end attached to the forward rotatable shaft, the flexible graphics sheet being adapted to be wound around the rear rotatable shaft or the forward rotatable shaft, the flexible graphics sheet being adapted to slide over the resilient graphics guide, the resilient graphics guide being adapted to urge the flexible graphics sheet into engagement with the viewing slot;

a right end piece and a left end piece adapted to rotatably hold the front rotatable shaft and the rear rotatable shaft; and, a cursor assembly, the cursor assembly being slidably engageable upon the housing, the cursor assembly having a rib adapted to correspond with the viewing slot, the rib having hairline means thereon, the rib being adapted to engage the flexible graphics sheet and bring the hairline means into engagement with the scales to reduce parallax problems when the hairline means is viewed from different viewing angles.

2. The drafting instrument according to claim 1, further comprising:

a fixed hairline register oriented in precise correspondence with a zero position on the scales.

3. The drafting instrument according to claim 1, further comprising:

a right forward knob and a left forward knob, the forward knobs being adapted to fit on the ends of the forward rotatable shaft and to facilitate rotation of the forward rotatable shaft.

4. The drafting instrument according to claim 3, further comprising:

a right rear knob and a left rear knob, the rear knobs being adapted to fit on the ends of the rear rotatable shaft and to facilitate rotation of the rear rotatable shaft.

5. The drafting instrument according to claim 1, wherein:

the viewing slot comprises a narrow protective viewing slot, the narrow protective viewing slot being adapted to expose only a narrow portion of the flexible graphics sheet and to protect the flexible graphics sheet.

6. The drafting instrument according to claim 5, wherein: the flexible graphics sheet comprises Mylar.

7. The drafting instrument according to claim 6, wherein: the flexible graphics sheet has a thickness of about 3 mils.

8. The drafting instrument according to claim 5, wherein the housing completely encloses and protects the flexible graphics sheet except for the portion of the flexible graphics sheet that is exposed through the narrow protective viewing slot.

9. The drafting instrument according to claim 8, wherein:

the narrow protective viewing slot is sufficiently narrow to expose only a single scale at a time when such scale is aligned with the viewing slot.

10. The drafting instrument according to claim 1, wherein the cursor assembly further comprises a V-shaped groove at a lower edge of the cursor assembly positioned in corresponding alignment with the hairline means, the V-shaped groove being adapted to receive a marking instrument so that marks may be made on a working surface which correspond with a measurement indicated by the position of the hairline means relative to the scales.

11. The drafting instrument according to claim 7, wherein the housing is made from aluminum.

* * * * *